US010458184B2

(12) United States Patent
Finkenzeller et al.

(10) Patent No.: US 10,458,184 B2
(45) Date of Patent: Oct. 29, 2019

(54) GROUND PROCESSING TOOL AND A METHOD FOR CREATING A BOREHOLE IN THE GROUND

(71) Applicant: BAUER Maschinen GmbH, Schrobenhausen (DE)

(72) Inventors: Stefan Michael Finkenzeller, Reichertshofen (DE); Juergen Klippenstein, Augsburg (DE); Manfred Schweiger, Tandern (DE); Thomas Bauer, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 50 days.

(21) Appl. No.: 15/885,425

(22) Filed: Jan. 31, 2018

(65) Prior Publication Data

US 2018/0230748 A1 Aug. 16, 2018

(30) Foreign Application Priority Data

Feb. 13, 2017 (EP) ..... 17155833

(51) Int. Cl.
*E21B 10/44* (2006.01)
*E21B 21/00* (2006.01)
(Continued)

(52) U.S. Cl.
CPC ..... *E21B 3/00* (2013.01); *E21B 7/00* (2013.01); *E21B 10/44* (2013.01); *E21B 10/60* (2013.01); *E21B 21/00* (2013.01)

(58) Field of Classification Search
CPC . E21B 10/44; E21B 10/60; E21B 3/00; E21B 7/00; E21B 21/00; E02D 13/08;
(Continued)

(56) References Cited

U.S. PATENT DOCUMENTS 4,606,675 A * 8/1986 Mitani ..... E02D 3/126 405/263
5,135,058 A * 8/1992 Millgard ..... B09C 1/00 175/21
(Continued)

FOREIGN PATENT DOCUMENTS

EP 2 703 596 A1 3/2014
WO 00/50358 A 8/2000

OTHER PUBLICATIONS

An Office Action mailed by the Canadian Intellectual Property Office (CIPO) dated Feb. 26, 2019, which corresponds to Canadian Application No. 2,993,084 and is related to U.S. Appl. No. 15/885,425.
(Continued)

*Primary Examiner* — David J Bagnell
*Assistant Examiner* — Dany E Akakpo
(74) *Attorney, Agent, or Firm* — Studebaker & Brackett PC

(57) ABSTRACT

The invention relates to a ground processing tool and a method for creating a borehole in the ground, wherein ground material is removed by the ground processing tool and blended with a fluid in the created borehole to form a suspension, which is suctioned away via at least one opening in the at least one mixing blade and via the conducting channel in the central shaft.

11 Claims, 4 Drawing Sheets

Figure 1:
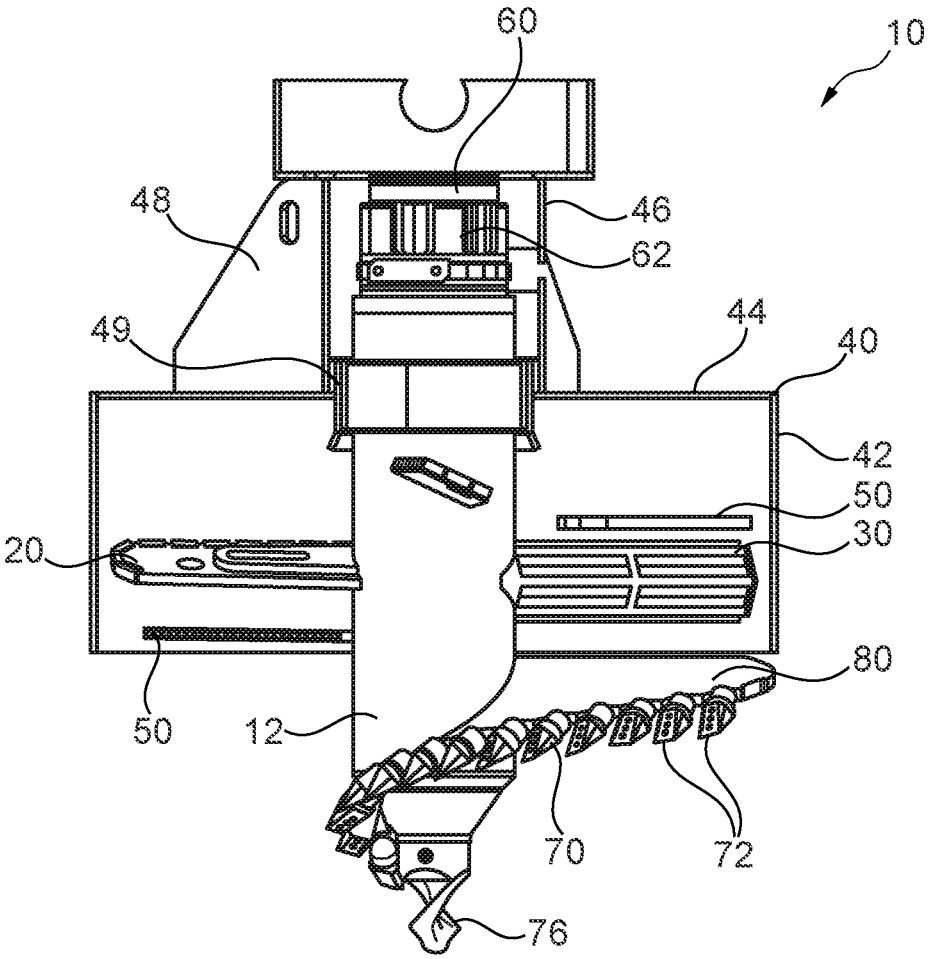

(51) Int. Cl.
*E21B 7/00* (2006.01)
*E21B 3/00* (2006.01)
*E21B 10/60* (2006.01)

(58) Field of Classification Search
CPC .... E02D 5/34; E02D 5/46; E02D 3/00; E02D 3/12; E02D 3/126; B08D 3/02
USPC ..... 175/213
See application file for complete search history.

(56) References Cited

U.S. PATENT DOCUMENTS

| | | | | |
|---|---|---|---|---|
| 2010/0276206 | A1 | 11/2010 | Borissov | |
| 2011/0253457 | A1 | 10/2011 | Shen et al. | |
| 2015/0322737 | A1* | 11/2015 | Finkenzeller | E02D 5/00 175/57 |

OTHER PUBLICATIONS

European Search Report issued by the European Patent Office dated Aug. 11, 2017, which corresponds to EP17155833.1-1614 and is related to U.S. Appl. No. 15/885,425.

* cited by examiner

GROUND PROCESSING TOOL AND A METHOD FOR CREATING A BOREHOLE IN THE GROUND

The invention relates to a ground processing tool, in particular a drilling tool, having a central shaft, built into which is a conducting channel, and having at least one mixing blade, which is attached to the central shaft and almost extends radially outward.

The invention furthermore relates to a method for creating a borehole in the ground using a ground processing tool, wherein ground material is removed by the ground processing tool and blended with a fluid in the created borehole to form a suspension, which is suctioned away via at least one opening in the at least one mixing blade and via the conducting channel in the ground processing tool.

Prior art of this generic kind follows from, for example, EP 2 703 596 A1. In this common drilling tool, a borehole is created by cutting means, which excavates ground material. The processed ground material is conveyed from the cutting means to an upper mixing area, where the processed ground material is crushed by means of mixing blades and blended with an added flushing liquid. The blended suspension is suctioned away via an opening in the middle of the bore shaft to be conveyed upward and out of the borehole.

The object of the invention is based on the specification of a ground processing tool and a method for creating a borehole; the use of which will enable the removed ground material to be crushed and mixed especially well.

The ground processing tool according to the invention is characterized in that at least one mixing blade is constructed to have an inner cavity, that the cavity communicates with the conducting channel in the central shaft, and that the outside of the mixing blade is constructed to have at least one opening to the cavity.

A fundamental idea behind the invention is made apparent by the fact that, in the mixing area, the processed ground material is further crushed by means of the rotating mixing blades, blended with an added fluid, and suctioned away via at least one opening in at least one mixing blade. As a consequence, the suctioning does not take place directly at the central shaft, but is rather separated in the mixing area. This leads to an overall improvement in the crushing and mixing of the ground material being removed. Furthermore, the mixing area is better utilized by achieving a relatively uniform consistency across large ranges of the mixing area as regards to the suspension being produced.

One preferential embodiment of the invention consists of providing a ring-like circumferential wall, which is mounted on the central shaft and encircles, ring-like, a mixing area, in which the at least one mixing blade is arranged. In this context, the ring-like circumferential wall nearly conforms with the diameter of the borehole, which in this case is typically somewhat smaller. A defined mixing area is encased by means of the ring-like circumferential wall, thus contributing to an improvement in the result of the mixing process.

According to a refinement of the invention, it is particularly preferable for the circumferential wall to feature an upper deck area, whereby a hood-like mixing bell is formed. The mixing area is delimited thereby in an upward direction so that essentially only the removed ground material and the fluid, in particular the flushing liquid, is added into the mixing area. The flushing fluid can be the supporting fluid in the borehole, or it can be a special fluid which is introduced directly into the mixing area via a feed line. In principle, both the ring-like circumferential wall and the deck area can be rigidly attached to the central shaft. According to a refinement of the invention, it is advantageous for the ring-like circumferential wall to be mounted so as to be rotatable with respect to the central shaft. As a result thereby, additional shear forces are generated within the mixing area, thus leading to mixing and crushing improvements.

A further preferential embodiment of the invention consists of multiple mixing blades being arranged on the central shaft. In this context, multiple mixing blades having both the cavity and openings can be provided. It is also advantageous in this context for regular mixing blades without a cavity be provided in addition to said hollow mixing blades. Preferably, the regular mixing blades and the mixing blades furnished with extraction openings are arranged around the central shaft in a distributed manner. The mixing blades can feature a front cutting edge which is reinforced with closing plates or cutting plates.

According to a refinement of the invention, the shear forces in the suspension being mixed are further increased by means of at least one mixing element being arranged on an inner side of the ring-like circumferential wall. Preferably, multiple mixing elements are provided, and they are preferably constructed as sheets protruding in a radial direction.

According to a refinement of the invention, it is preferable when connecting means for a joint connection with a suction apparatus is provided in the upper area of the central shaft. In particular, one or multiple drill pipes, which preferably extend into an area outside of the borehole, can be attached. The suspension removed can be discharged farther from this area by means of hose means having a rotary connection. It is thus possible to discharge the removed ground material in an especially environmentally safe manner, particularly given cohesive soils.

In principle, the ground processing tool can be used purely as a mixing or crushing component. A preferential embodiment of the invention consists of removal means being arranged on a lower side for removing ground material. The removal apparatus features removal teeth for removing the ground material. In principle, the teeth are detachably mounted in corresponding tooth fastenings.

According to a further embodiment of the invention, it is particularly advantageous for conveying means used to convey the removed ground material to be arranged between the removal means and the at least one mixing element.

The conveying means can, in this case, feature a single or multiple spiral conveyor(s). The ground material, which is still relatively coarse, is removed by the removal means and conveyed upward into the mixing and crushing area by means of the conveying means. The ground material is crushed in the manner desired by means of the rotating mixing elements, which are preferentially furnished with a front cutting edge. In this case, a flushing or supporting fluid is introduced directly or indirectly into the mixing space, whereby the fluid is blended with the crushed ground material by means of the mixing blades to form a suspension. This suspension can preferentially be continuously suctioned away via the openings in the at least one mixing blade. However, it is in principle also possible to feed fluid directly into the mixing area via one or multiple openings in the at least one mixing blade.

The invention furthermore relates to a drilling device for earth and rock drilling, which is characterized in that a ground processing tool is provided in the manner previously described. The drilling device can be provided with an undercarriage for drilling on land or on a vessel, for example a pontoon or a drillship.

According to a refinement of the invention, suction means is provided, using which removed ground material can be suctioned away through the conducting channel in the central shaft via the at least one opening in the mixing blade. The suction means can, in this case, be a pump which is arranged on the drilling device outside of the borehole.

The invention furthermore relates to a method for creating a borehole in the ground using the previously described ground processing tool, wherein ground material is removed by the ground processing tool and blended with a fluid in the created borehole to form a suspension, which is suctioned away via at least one opening in the at least one mixing blade and via the conducting channel in the central shaft. The previously described advantages are able to be achieved using this method.

A preferential variation of the inventive method consists of the suspension being discharged from the borehole. In this manner, hard rock material or erratics within a drill pipe or a foundation pipe can be processed, crushed, and discharged from the borehole in a suspension. This is particularly advantageous in offshore applications, for example in introducing foundation pipes for wind turbines or current turbines.

Figure 2:
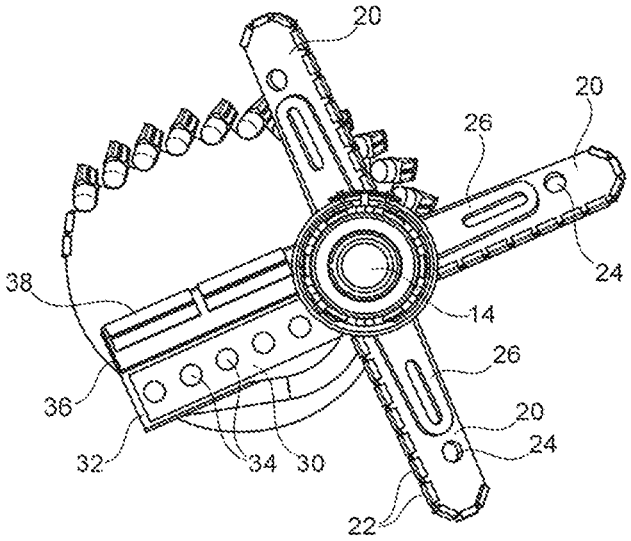
Figure 3:
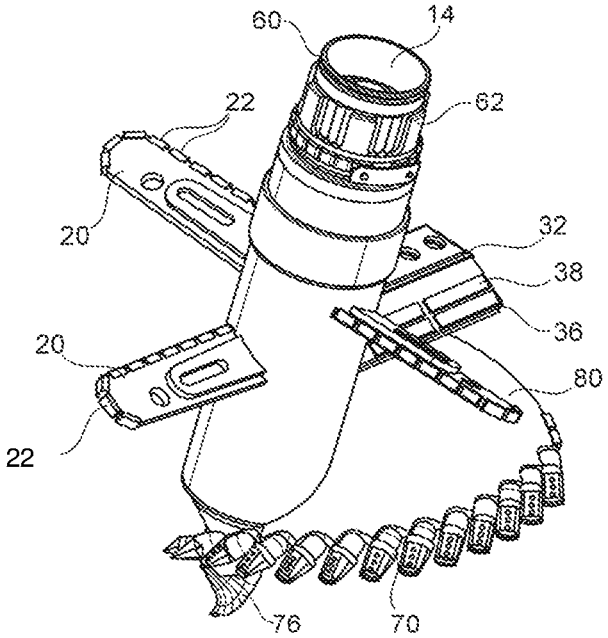
Figure 4:
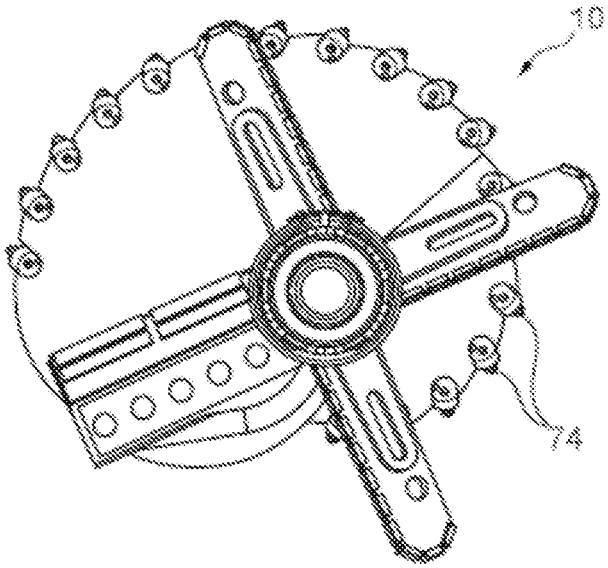
Figure 5:
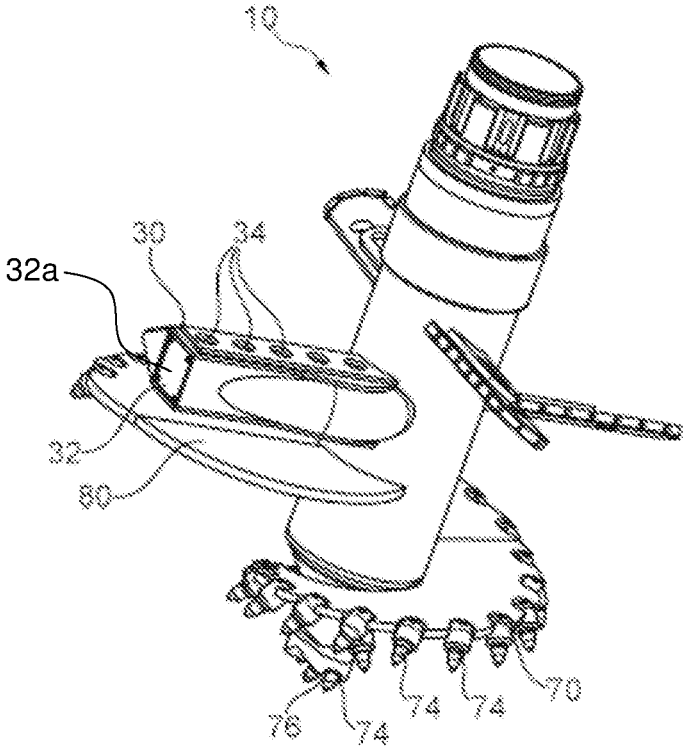
Figure 6:
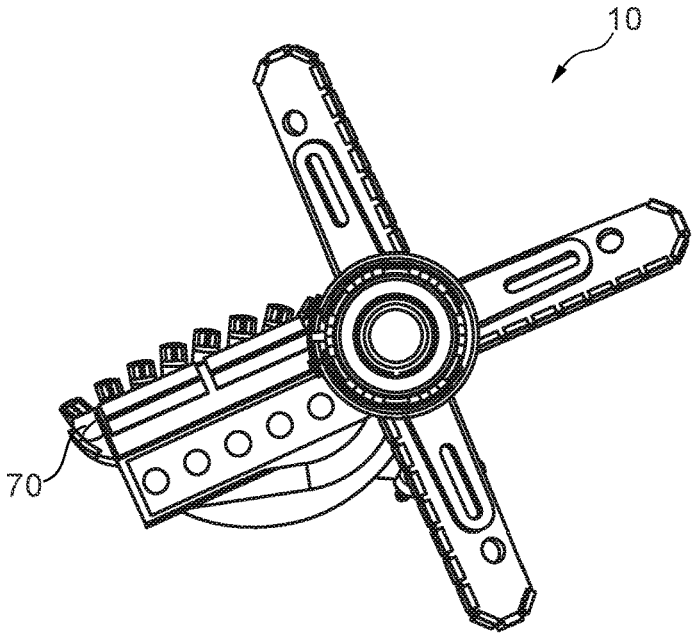
Figure 7:
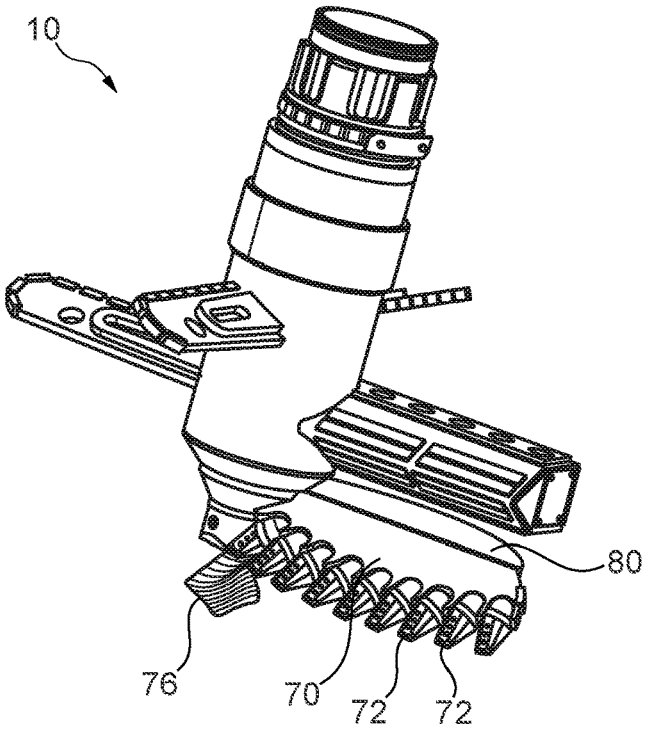

The invention will be described hereinafter by way of preferential embodiments, which are schematically depicted in the drawings. Shown in the drawings are:

FIG. 1 a schematic cross-section view through a ground processing tool according to the invention;

FIG. 2 an overhead view of the ground processing tool according to FIG. 1;

FIG. 3 a perspective view of the ground processing tool shown in FIG. 1 and FIG. 2;

FIG. 4 an overhead view of a further ground processing tool according to the invention;

FIG. 5 a perspective view of the ground processing tool shown in FIG. 4;

FIG. 6 an overhead view of a third ground processing tool according to the invention; and FIG. 7 a perspective view of the ground processing tool shown in FIG. 6.

A ground processing tool 10 according to the invention as shown in FIG. 1 features a tube-shaped central shaft 12, at the lower end of which a centering spike 76 is arranged. Removal means 70 starts at the centering spike 76 and extends upward in a helical shape along the central shaft 12. Flat teeth 72 having cutting edges are, in this case, arranged on the outer edge of a helical drill, which transitions into conveying means 80 for the upward transport of the removed ground material. The removed ground material 80 is conveyed by means of the conveying means into a mixing area in the central area of the central shaft 12. Flat mixing blades 20 on the central shaft 12 projecting in a radial direction and a single box-shaped mixing blade 30 are arranged in this mixing area.

As is evident from FIGS. 2 and 3 in particular, the box-shaped mixing blade 30 features an almost rectangular, hollow suction box 32. Arranged on the top thereof are five circular openings 34 for suctioning the suspension away from the mixing area. An arrow-like frontal area 36, onto which wear plates 38 are attached, is arranged on the forward-facing (in the direction of rotation) side of the box-shaped mixing blade 30.

The inner cavity 32*a* of the suction box of the box-shaped mixing blade 30 communicates with a central conducting canal 14, which is formed in the tube-shaped central shaft 12, via a passage (not depicted) through the central shaft 12.

Arranged on an upper side of the central shaft 12 is a connecting means 60, which can be used to connect the central shaft 12 with additional drill pipes by way of a joint connection. An axially directed spline profile 62 used for transmitting torque via the drill pipe is furnished on the top exterior of the central shaft 12. This profile engages in a positive lock with a corresponding spline profile on an inner side of the attached drill pipe. In this manner, torque from a rotary drive in a drilling apparatus (not depicted) can be transmitted to the ground processing tool 10.

In the central mixing area of the ground processing tool 10, the ground material removed by the removal apparatus 70 is blended with added fluid to form a suspension. The radially projecting mixing blades 20, 30 do not, in this case, serve a mixing purpose, but are rather used to further crush the removed ground material, which is thus able to be reliably suctioned away via the openings 34 along with the fluid by means of the vacuum created by a pump (not depicted). In order to improve the mixing and crushing effect, cutting plates 22 made of hard metal are welded to the flat, sword-shaped mixing blades 20, the front sides of which are slender. Furthermore, a recess 24 and a support plate 26 are arranged on each sword-shaped mixing blade 20, the result of which is enhancing the turbulence created and enhancing the mixing effect thereby.

In order to further improve the mixing effect, the central mixing area on the central shaft 12 is covered by a bell-like mixing hood 40, which is only depicted in FIG. 1. The mixing hood 40 features a cylindrical, drum-shaped circumferential wall 42, which is open on the bottom and ends in an upper plate-shaped deck area 44 on the top. The top end of the deck area 44 encloses an axially directed sleeve bearing 46, which is rigidly connected to the deck area 44 by means of stiffening plates 48. Via the sleeve bearing 46, the mixing hood 40 is rotatably mounted on and in relation to the central shaft 12 via a sliding sleeve 49. Arranged on the inner side of the cylindrical circumferential wall 42 are strut-shaped mixing elements 50, which cause the shear forces within the mixing area to increase.

The edges of the mixing surfaces can be furnished with pointed wear elements.

A further ground processing tool 10 according to the invention, which is likewise constructed as a drilling tool, is depicted in FIGS. 4 and 5. For the sake of clarity, the bell-like mixing hood 40, which is constructed in the manner of the previous embodiment, has been left out. This second embodiment of a ground processing tool 10 according to the invention is constructed largely in the manner of the previously described ground processing tool 10 according to FIGS. 1 to 3, but in this case drill bits 74 with pointed eroding cutters are provided as removal means 70 instead of the flat teeth 72. The drill bits 74 are arranged in corresponding drill bit fastenings along the free edge of the helical conveying means 80, the diameter of which gradually increases in going from the centering spike 76 to the maximum outer diameter above. In this embodiment according to FIGS. 4 and 5, the centering spike 76 is likewise constructed to have drill bits 74. A particularly vivid representation of the box-shaped mixing element 30 with the rectangular suction box 32 is made in the illustration according to FIG. 5. Arranged on the top thereof are openings 34 for suctioning away the suspension formed by the fluid and the crushed ground material.

A particularly compact ground processing tool 10 according to the invention is shown in FIGS. 6 and 7, in which context the bell-like mixing hood 40 is likewise left out for the sake of clarity. The ground processing tool 10 according to FIGS. 6 and 7 differs from the previous ground processing tools in that the removal means 70 used for removing the ground materials is constructed essentially as a cutting edge running in a radial direction. In this case, the cutting edge is constructed as a large number of flat teeth 72 protruding in a circumferential direction. The adjoining surface is designed as a short helical segment forming a conveying means 80. For centering, a centering spike 76 is provided which conforms with the first embodiment according to FIGS. 1 to 3.

All variations of the ground processing tool 10 according to the invention can be used in a conventional drilling tool having an undercarriage, an upper structure, and a mast having a top drive, and particularly used in Flydrill systems and onshore and offshore drilling systems. The ground processing tool is attached at the bottom of a drill string, which is driven by the drive in a rotary direction and can be moved up and down in an axial direction. The ground material is removed via a feed opening (not depicted here) and blended with a fluid in the mixing area beneath the mixing hood 40 by means of the rotating mixing blades 20, 30. By means of the mixing blades 20, 30, the removed ground material is crushed yet further so that the suspension produced is suctioned away via the openings 34 in the box-shaped mixing blade 30 and via the conducting channel 14 to be conducted upward and out of the borehole. The outer diameter of the mixing hood 40 essentially conforms with the bored diameter of the borehole being created by means of the removal means 70.

The circular deck area 44 of the mixing hood 40 separates the mixing area from the borehole area thereabove. In this area, the borehole can be backfilled with a supporting fluid or a supporting suspension. It is ensured by means of the mixing hood that any undesired mixing between the supporting fluid or the supporting suspension and the removed ground material is avoided in the mixing area beneath the mixing hood 40.

After the borehole has been sunk and the removed ground material thus conveyed, the drilling tool can be removed from the borehole. The supporting fluid can, in this case, be recovered while the borehole is being backfilled with a hardenable suspension. This can be hardened into a bored pile in the ground.

The invention claimed is:

1. A ground processing tool having a central shaft including a conducting channel built therein, the ground processing tool having at least one mixing blade attached to the central shaft and extending radially outward, wherein the at least one mixing blade comprises an inner cavity, the inner cavity communicates with the conducting channel in the central shaft, an outside of the mixing blade comprises at least one opening to the inner cavity, a removal apparatus is arranged on a lower side of the ground processing tool and is configured for removing ground material, a ring shaped circumferential wall is mounted on the central shaft and encircles a mixing area in which the at least one mixing blade is arranged, and a conveyor configured to convey the removed ground material is arranged between the removal apparatus and the at least one mixing blade.

2. The ground processing tool according to claim 1, wherein the circumferential wall includes an upper deck area that includes a hood-like mixing bell formed therein.

3. The ground processing tool according to claim 1 wherein the ring shaped circumferential wall is configured to be rotatable with respect to the central shaft.

4. The ground processing tool according to claim 1, further comprising multiple mixing blades arranged on the central shaft.

5. The ground processing tool according to claim 1, wherein at least one mixing element is attached to an inner side of the ring shaped circumferential wall.

6. The ground processing tool according to claim 1, further comprising a connecting apparatus for a joint connection with a suction apparatus provided in an upper area of the central shaft.

7. The ground processing tool according to claim 1, further comprising strut-shaped mixing elements arranged at the ring shaped circumferential wall.

8. A drilling device for earth and rock drilling, comprising the ground processing tool according to claim 1.

9. The drilling device according to claim 8, further comprising a suction pump configured to suction away ground material through the conducting channel in the central shaft via the at least one opening in the mixing blade.

10. A method for creating a borehole in the ground using a ground processing tool according to claim 1, the method comprising:

removing ground material with the ground processing tool;

blending the removed ground material with a fluid in the created borehole to form a suspension, and suctioning the suspension away via the at least one opening in the at least one mixing blade and via the conducting channel in the central shaft.

11. The method according to claim 10, further comprising:

discharging the suspension from the borehole.

* * * * *